US009824610B2

(12) United States Patent
Mazini et al.

(10) Patent No.: US 9,824,610 B2
(45) Date of Patent: Nov. 21, 2017

(54) VEHICLE IDENTIFICATION NUMBER (VIN) LABEL

(75) Inventors: Denis L. Mazini, Sao Paulo (BR); Zachary A. Romme, Sterling Heights, MI (US); D. Lucia Klose, Birmingham, MI (US); William A. Biondo, Beverly Hills, MI (US); Frankie K. Thomas, Oxford, MI (US); Kevin W. Snider, Lake Orion, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 1051 days.

(21) Appl. No.: 12/777,544

(22) Filed: May 11, 2010

(65) Prior Publication Data

US 2011/0281041 A1 Nov. 17, 2011

(51) Int. Cl.

| | |
|---|---|
| ***G09F 3/10*** | (2006.01) |
| ***G09F 21/04*** | (2006.01) |
| ***G09F 3/00*** | (2006.01) |

(52) U.S. Cl.

CPC ..... *G09F 3/10* (2013.01); *G09F 3/0292* (2013.01); *G09F 21/04* (2013.01); *Y10T 428/24331* (2015.01)

(58) Field of Classification Search

USPC ..... 428/195.1, 29, 31, 354; 283/72; 156/134

See application file for complete search history.

(56) References Cited

U.S. PATENT DOCUMENTS

| | | | | |
|---|---|---|---|---|
| 4,031,640 | A * | 6/1977 | Hanna et al. | 283/77 |
| 6,372,341 | B1 | 4/2002 | Jung et al. | |
| 6,428,051 | B1 * | 8/2002 | Herrmann et al. | 283/107 |
| 2005/0067497 | A1 * | 3/2005 | Jones et al. | 235/492 |
| 2006/0211572 | A1 * | 9/2006 | Yukawa | 503/227 |
| 2010/0189979 | A1 * | 7/2010 | Takeda et al. | 428/216 |
| 2010/0295290 | A1 * | 11/2010 | Muth et al. | 283/109 |

FOREIGN PATENT DOCUMENTS

| | | | |
|---|---|---|---|
| DE | 10050553 | A1 | 4/2002 |
| WO | WO 2009013923 | A1 * | 1/2009 |
| WO | WO 2009056352 | A1 * | 5/2009 |
| WO | 2009149039 | A1 | 12/2009 |

* cited by examiner

*Primary Examiner* — Laura Powers
(74) *Attorney, Agent, or Firm* — Lorenz & Kopf, LLP

(57) ABSTRACT

A vehicle identification number (VIN) label is provided. The label includes an adhesive layer; a self-destruct layer positioned on the adhesive layer; a first facestock layer positioned on the self-destruct layer; a second facestock layer positioned on the first facestock layer and defining a first window relative to the first facestock layer; and an indicia layer with a first vehicle identification number (VIN) within the first window of the second facestock layer.

19 Claims, 3 Drawing Sheets

VEHICLE IDENTIFICATION NUMBER (VIN) LABEL

TECHNICAL FIELD

The present invention generally relates to labels, and more particularly relates to tamper-evident vehicle identification number (VIN) labels.

BACKGROUND OF THE INVENTION

Vehicle identification numbers (VINs) are common mechanisms for identifying vehicles both in the U.S. and internationally. Generally, a VIN is a unique alphanumeric character sequence assigned to each new vehicle by its manufacturer. Conventionally, the VIN is etched onto a metal VIN plate and subsequently attached to the dashboard and/or to other parts of the vehicle, such as the engine block or rear axle. These VIN plates are useful for determining if vehicles are properly registered and also for locating and returning stolen vehicles.

VIN plates, however, may be limited in a number of respects. For example, a metal VIN plate can be removed and illegally reapplied to another vehicle by thieves or counterfeiters. Additionally, manufacturing the VIN plates with embossed or permanently formed identifiers may be expensive and/or labor intensive. Some paper or plastic VIN labels have been proposed, although conventional printed labels identifiers are easily counterfeited.

Accordingly, it is desirable to provide a mechanism for identifying a vehicle label that is tamper-resistant, cost effective, and not subject to being counterfeited. Furthermore, other desirable features and characteristics of the present invention will become apparent from the subsequent detailed description and the appended claims, taken in conjunction with the accompanying drawings and the foregoing technical field and background.

SUMMARY OF THE INVENTION

In accordance with an exemplary embodiment, a vehicle identification number (VIN) label is provided. The label includes an adhesive layer; a self-destruct layer positioned on the adhesive layer; a first facestock layer positioned on the self-destruct layer; a second facestock layer positioned on the first facestock layer and defining a first window relative to the first facestock layer; and an indicia layer with a first vehicle identification number (VIN) within the first window of the second facestock layer.

In accordance with another exemplary embodiment, a method is provided for forming a vehicle identification number (VIN) label. The method includes coating an underside of a self-destruct layer with an adhesive layer; positioning a first facestock layer over the self-destruct layer; positioning a second facestock layer on the first facestock layer such that the second facestock layer defines a first window relative to the first facestock layer; and printing a indicia layer with a first vehicle identification number (VIN) within the first window of the second facestock layer.

DESCRIPTION OF THE DRAWINGS

The present invention will hereinafter be described in conjunction with the following drawing figures, wherein like numerals denote like elements, and wherein.

DESCRIPTION OF AN EXEMPLARY EMBODIMENT

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Broadly, exemplary embodiments discussed herein provide vehicle identification number (VIN) labels with a number of security features, including a self-destruct layer, a watermark layer, and a UV layer. The VIN and other identifying indicia may be printed on the label with reverse thermal transfer techniques.

Figure 1:
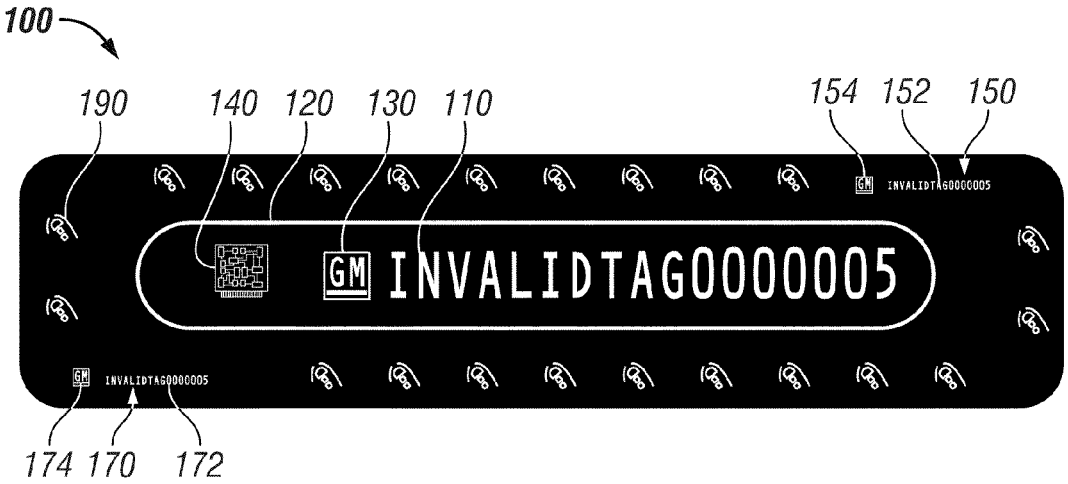
FIG. 1 is a front view of a vehicle identification number label in accordance with an exemplary embodiment.

FIG. 1 is a front view of a VIN label 100 in accordance with an exemplary embodiment. As discussed in greater detail below, the label 100 generally includes a unique identifier, which in this exemplary embodiment is a VIN 110 arranged within a central region 120. The label 100 is configured to be attached to a vehicle (not shown). In one exemplary embodiment, the label 100 is positioned on or adjacent to the dashboard of a vehicle such that only the central region 120 is visible through the windshield. Other locations may include door jambs, engine well, quarter panels, hood, and trunk. Label 100 may be any suitable size, and in one exemplary embodiment, is approximately 10 cm by 2 cm.

In one exemplary embodiment, the VIN 110 includes seventeen (17) characters in sequential positions from left to right as required by many state and national governments. The VIN 110 may indicate the country of origin of the vehicle, the manufacturer of the vehicle, the make and model of the vehicle, attributes of the vehicle, model year, assembly plant, and production numbers that uniquely identify the vehicle.

Additional indicia may be provided in the central region 120 of the label 100, including a logo 130 and a two dimensional bar code 140. The logo 130 typically corresponds to the manufacturer of the vehicle, but also functions as a delimiter for the VIN 110. The bar code 140 may be a machine readable representation of the VIN 110.

A second VIN 152 and a second logo 154 are arranged in a second region 150 of the label 100, and a third VIN 172 and third logo 174 are arranged in a third region 170 of the label 100. In the depicted exemplary embodiment, the second VIN 152 and second logo 154 are arranged in an upper right corner, and the third VIN 172 and third logo 174 are arranged in a lower left corner. The label 100 further includes a number of watermark symbols 190, which in this exemplary embodiment, appear as lock symbols. Any additional indicia may be provided in or outside of the central region 120, including, for example, letters, pictures, numbers, symbols, patterns and words.

Figure 2:
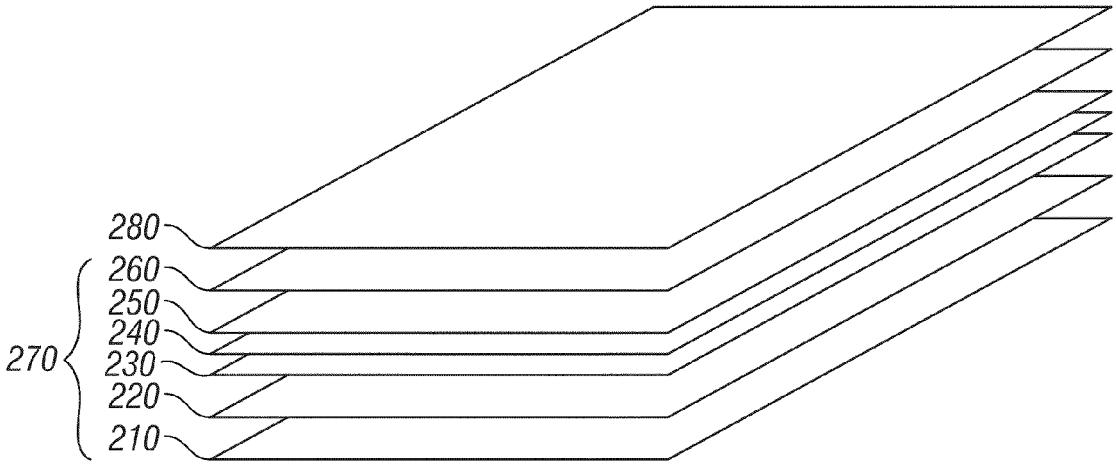
FIG. 2 is an exploded isometric view of the vehicle identification number label of FIG. 1.

FIG. 2 is an exploded isometric view of the label 100 of FIG. 1. As shown, the label 100 generally includes a number of layers 210, 220, 230, 240, 250, 260, 280. In the depicted embodiment, the label 100 includes an adhesive layer 210, a self-destruct layer 220, a gray facestock layer 230, a black facestock layer 240, a watermark layer 250, a UV layer 260, and an indicia layer 280. Collectively, the adhesive layer 210, the self-destruct layer 220, the gray facestock layer 230, the black facestock layer 240, the watermark layer 250, and the UV layer 260 are referred to as an intermediate label 270. Subsequently, the indicia layer 280 is added to the intermediate label 270 to form the final label 100. Each of these layers will be sequentially described below with reference to FIGS. 3-8.

Figure 3:
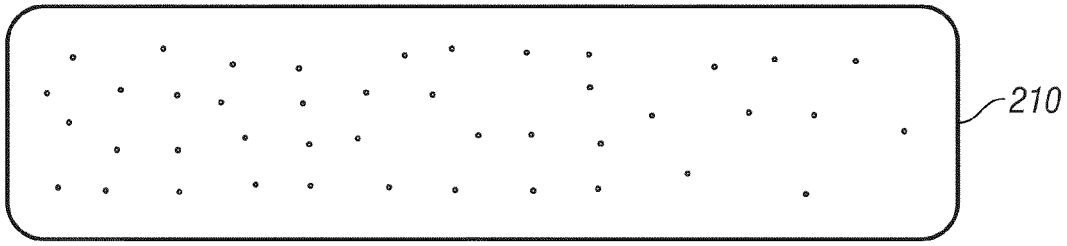
FIG. 3 is front view of an adhesive layer of the vehicle identification number label of FIGS. 1 and 2.

FIGS. 3-7 are front views of various stages of forming the label 100 of FIGS. 1 and 2, and in particular, illustrate an exemplary sequential formation of the intermediate label 270. In other embodiments, the label 100 may be formed in a different sequential order, such as progressing from FIG. 6 to FIG. 3. FIG. 3 corresponds to the adhesive layer 210 and is configured to permanently secure the label 100 to the vehicle. The adhesive layer 210 may a formed as a film, coating, and/or hot melt. Any suitable adhesive may be provided for the adhesive layer 210, including a pressure-sensitive adhesive and/or solvent- or water-based adhesives using acrylics, polymers, and rubber.

Figure 4:
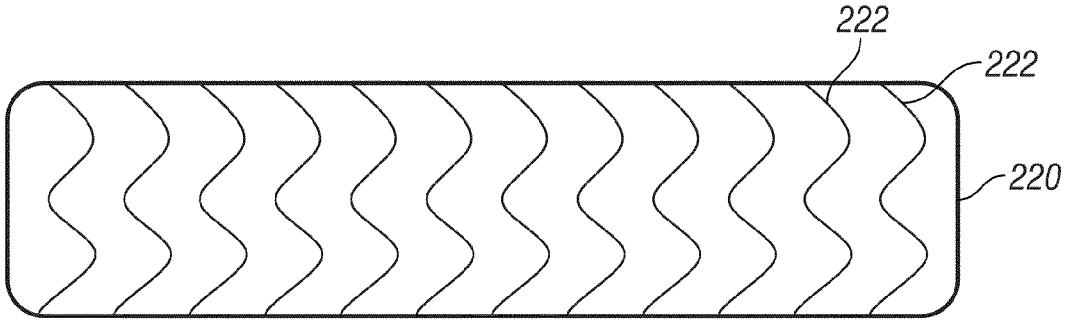
FIG. 4 is front view of a self-destruct layer of the vehicle identification number label of FIGS. 1 and 2.

FIG. 4 is front view of a self-destruct layer 220 of the vehicle identification number label of FIGS. 1 and 2. The adhesive layer 210 of FIG. 3 is coated on an underside of the self-destruct layer 220. In general, the self-destruct layer 220 is any layer that indicates tampering with the label 100. As discussed herein, tampering may be considered any removal or attempted removal of the label 100 from the vehicle to which it was attached. Such evidence is usually visible to the unaided eye, as discussed below.

In the depicted embodiment, the self-destruct layer 220 includes a number of slits 222 along the length of the self-destruct layer 220. Tampering with the applied label 100 results in a shear and/or tensile tearing of label 100 along the slits 222 of the self-destruct layer 220, thereby providing visible evidence of tampering. For example, during an attempted removal, an edge-most area of the label 100 may be able to be urged away from the underlying vehicle; however, upon further removal, the portion of the edge beyond the first slit 222 will remain adhered to the vehicle as the other layers tear, since the adhesive bonds are stronger than the tensile strength of the label 100. Such tears are typically designed to extend through the VIN 110 of the final label 100 such that reuse or reapplication of the label 100 is impossible. In addition to the slits 222, the self-destruct layer 220 may include additional adhesives of varying adhesion strengths such that some portions of the self-destruct layer 220 are more likely to be removed with an upper layer (e.g., the gray facestock layer 230 as discussed below) while other portions of the self-destruct layer 220 are more likely to remain on the vehicle with the adhesive layer 210. Accordingly, attempts to remove the label 100 generally results in rupture of the film that may be removed only in small pieces, thus substantially reducing the likelihood of label reuse.

Figure 5:
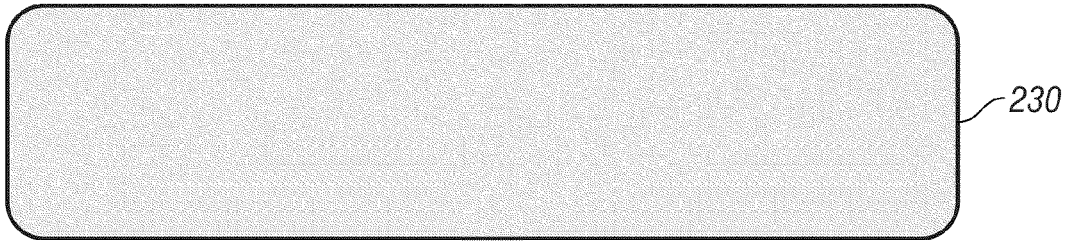
FIG. 5 is front view of a gray facestock layer of the vehicle identification number label of FIGS. 1 and 2.
Figure 6:
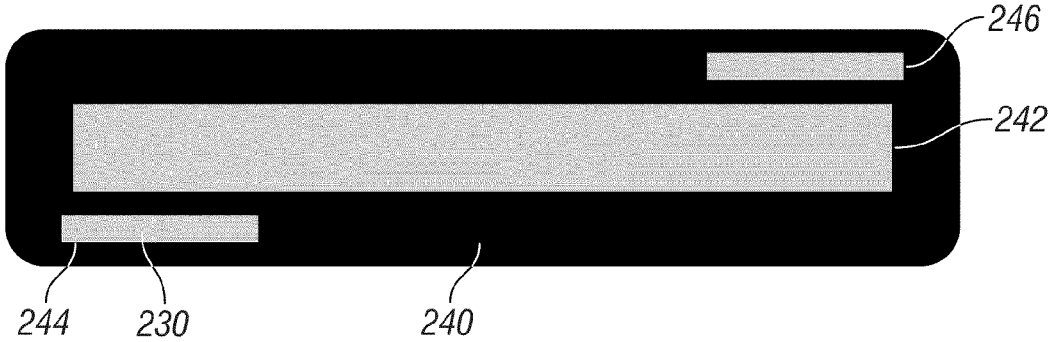
FIG. 6 is front view of black facestock layer of the vehicle identification number label of FIGS. 1 and 2.

FIG. 5 is front view of a gray facestock layer 230 of the vehicle identification number label of FIGS. 1 and 2. The gray facestock layer 230 is positioned over and is coextensive with the self-destruct layer 220 of FIG. 4. In particular, an underside of the gray facestock layer 230 may be adhered to the self-destruct layer 220. FIG. 6 is front view of black facestock layer 240 of the vehicle identification number label 100 of FIGS. 1 and 2. The black facestock layer 240 is positioned over the gray facestock layer 230 of FIG. 5. In the depicted embodiment, the black facestock layer 240 defines a first window 242 relative to the gray facestock layer 230. The first window 242 is generally positioned in the center of the gray facestock layer 230. Additionally, the black facestock layer 240 defines second and third windows 244, 246 relative to the gray facestock layer 230. In one embodiment, the windows 242, 244, 246 are formed by cut-outs in the black facestock layer 240.

As discussed in greater detail below, the windows 242, 244, 246 in the black facestock layer 240 render visible portions of the gray facestock layer 230 that correspond to the regions 120, 150, 170 in which the VIN 110 and other identifying indicia 130, 140, 150, 160, 170, 180 are subsequently printed. As such, although the facestock layers 230, 240 are described as gray and black, the layers may be any contrasting colors, as necessary or desired. For example, in one exemplary embodiment, the facestock layer 230 may be white or silver.

The gray and black facestock layers 230, 240 may be formed, for example, from a paper material such as cardboard, or a resinous plastic material, such as vinyl or polyester. For example, the gray and black facestock layers 230, 240 may include plain paper, coated paper, resin-coated paper, synthetic paper, laminates, foils, or cellulose derivatives. In one exemplary embodiment, the gray and black facestock layers 230, 240 are formed by subsurface printing. In other words, each of the gray and black facestock layers 230, 240 may be applied as wet ink, which is then cured. The gray and black facestock layers 230, 240 may additionally function as an adhesive relative to the other layers.

Figure 7:
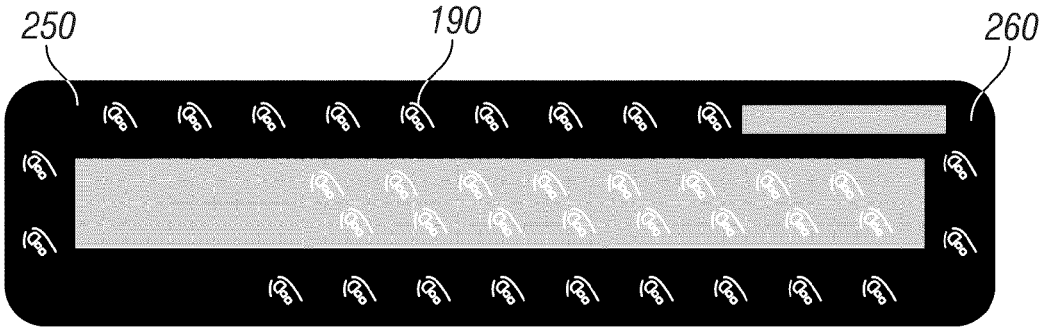
FIG. 7 is front view of watermark and UV layers of the vehicle identification number label of FIGS. 1 and 2.

The watermark layer 250 and the UV layer 260 may be positioned over and coextensive with the gray and black facestock layers 230, 240, as shown in FIG. 7. The watermark layer 250 is generally transparent and includes a number of watermark symbols 190. The watermark layer 250 may be plastic and secured to the facestock layers 230, 240 with adhesive. As noted above, the watermark symbols 190, in this exemplary embodiment, correspond to lock symbols. White or clear ink used to produce the watermark symbols 190, although any symbol or color may be provided as desired.

The UV layer 260 is a transparent layer coextensive with the watermark layer 250. In one exemplary embodiment, the UV layer 260 may be a surface coating on the watermark layer 250 applied by brushing, blade coating, or spraying a liquid UV solution. In another exemplary embodiment, the UV layer 260 is a transparent film of plastic or other material impregnated with UV sensitive material. Particularly, the UV materials in the UV layer 260 fluoresce under UV light. As such, the UV layer 260 provides a clear and evenly luminescing total effect when exposed to UV light of varying forms, such as black lights, UV tubes, and UV diode array flashlights.

Figure 8:
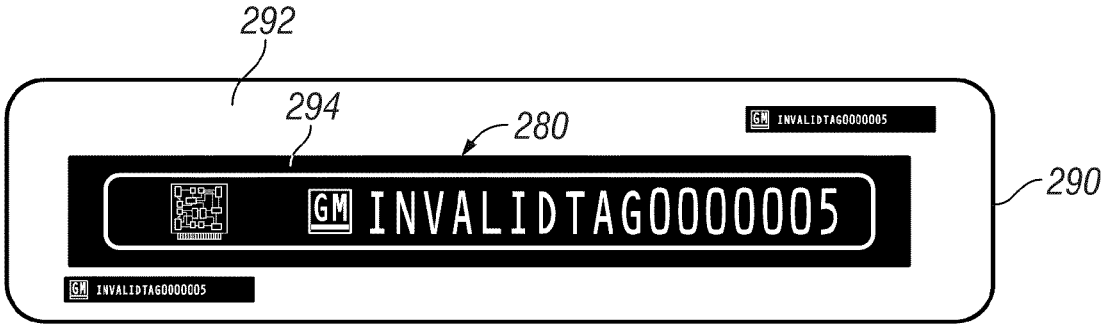
FIG. 8 is front view of a thermal transfer film for forming an indicia layer of the vehicle identification number label of FIGS. 1 and 2.

As noted above, the adhesive layer 210, the self-destruct layer 220, the gray facestock layer 230, the black facestock layer 240, the watermark layer 250, and the UV layer 260 form the intermediate label 270, as depicted in FIG. 7. Subsequently, the thermal transfer film 290, as shown in FIG. 8, is used to apply the indicia layer 280 onto the intermediate label 270. The indicia layer 280 forms the VIN 110 and other identifying indicia 130, 140, 150, 160, 170, 180 of the final label 100, as shown in FIG. 1. As such, the intermediate label 270, particularly the uppermost watermark and UV layers 250, 260, is constructed to be receptive to printing, such that a thermal transfer ink may applied and permitted to cure, as will now be discussed.

The thermal transfer film 290 generally includes a substrate 292 and ink 294 adhering to the underside of the substrate 292. During assembly of the final label 100, the thermal transfer film 290 is arranged in proximity to the intermediate label 270 such that the ink 294 is registered with the windows 242, 244, 246 discussed above. Energy, such as heat or laser energy, is applied to the top of the substrate 292, and in response, the ink 294 on the underside of the substrate is transferred to the intermediate label 270. The energy may be applied, for example, by a resistance heating element that presses the thermal transfer film 290 against the intermediate label 270 for transfer of the indicia layer 280 under heat and pressure.

The substrate 292 of the thermal transfer film 290 may be formed by any material suitable for transferring the ink 294 while withstanding the heat of thermal transfer. Such materials may include polyesters, plastics, or paper. Any ink 294 suitable for thermal transfer may be provided, such as one or more dyes, pigments, colorants, or a combination thereof. In the exemplary embodiment, the ink 294 is black, although any color may be used. In the exemplary embodiment, the entire indicia layer 280 is formed by the ink 294 of the thermal transfer film 290, although in other embodiments, the indicia layer 280 may be formed by more than one thermal transfer film 290. Other printing techniques may be used to form the indicia layer 280, including ink jet printing, electrostatic printing and/or direct thermal printing. The combination of the thermal transfer film 290 and intermediate label 270 enables a manufacturing process that provides security features with flexible and customizable indicia.

In the exemplary embodiment, the indicia layer 280 is formed by reverse thermal printing such that the indicia layer 280 acts a mask or stencil to form the VIN 110 and other identifying indicia 130, 140, 150, 160, 170, 180. To an observer, the indicia layer 270 overlaps the black facestock layer 240 to form a solid black label 100, except for the gray facestock layer 230 visible through the indicia layer 280 that forms the VIN 110 and other identifying indicia 130, 140, 150, 160, 170, 180 illustrated by FIG. 1.

Generally, the intermediate label 270 may be provided as a sheet or continuous roll that includes more than one intermediate label 270. Such a sheet or roll may be fed through a printing device to transfer the indicia layer 280 from the thermal transfer film 290 to the intermediate label 270 to form the final label 100. Subsequently, a cutter may be provided to divide the sheet or roll into individual labels 100 of desired lengths, either by complete cutting or perforations that enable tearing. Such arrangements enable the purchase of the intermediate label 270 by the manufacturer, which may then assign the VIN and print the final label 100 on demand.

Although a number of layers of the label 100 have been discussed above, in further embodiments, additional layers or treatments may be provided and/or layers discussed above may be omitted. For example, although not shown, a top coat layer may be applied over the indicia layer 280. Such a top coat layer may be transparent and formed from silicone, polyurethane tetrafluoride, and polypropylene. The top coat may provide protection against image deterioration or alteration due to exposure to light, temperature, chemicals, and moisture, as well as promoting anti-curl properties and a glossy finish.

Additionally, the label 100 may be provided with a release liner (not shown) that protects the adhesive layer 210 from damage and unwanted adhesion prior to application to the vehicle. The release liner may be paper or polymeric film that is treated with a release agent such as a polysiloxane or other silicone-based release materials, for example, to enable removal from the adhesive layer 210 for application onto the vehicle.

Accordingly, the label 100 provides a number of advantages relative to VIN plates, including unique security features such as multiple VINs 110, 152, 172; manufacturer logos 130, 154, 174; a self-destruct layer 220 to prevent counterfeiting and removal; visible watermark symbols 190 around the label 100; and a UV layer 260. The label 100 further provides the VINs 110, 152, 172 in compliance with global VIN standards and perceptual quality requirements. As such, plate manufacturing equipment, such as etching lasers, are not necessary, resulting in a substantial cost savings to vehicle manufacturers.

Although exemplary embodiments discussed above reference a label 100 for identifying vehicles, the concepts discussed herein may also be used for other identification labels, such as temporary vehicle registration plates, security signs, labels and cards, checks, bank drafts, money orders, safety warning labels, warranty seals, packaging seals, license labels, calibration seals, and other types of informational signs, labels, and cards. In general, the labels may be associated with any indicia that uniquely identify the object or device to which the label is attached While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A vehicle identification number (VIN) label, comprising:

an adhesive layer;

a self-destruct layer positioned on the adhesive layer;

a first facestock layer positioned on the self-destruct layer, the first facestock layer having a first color;

a second facestock layer positioned on the first facestock layer and defining a first window relative to the first facestock layer; and an indicia layer positioned over at least the first window of the second facestock layer, the indicia layer including a transparent portion and a printed portion, wherein the printed portion is a second color outlining a first vehicle identification number (VIN) relative to the transparent portion such that the first vehicle identification number (VIN) is formed by a contrast between the first color of the first facestock layer exposed through the first window of the second facestock layer and the second color of the printed portion.

2. The vehicle identification number (VIN) label of claim 1, further comprising a watermark layer disposed between the second facestock layer and the indicia layer.

3. The vehicle identification number (VIN) label of claim 2, wherein the watermark layer includes a plurality of watermark symbols surrounding the first window.

4. The vehicle identification number (VIN) label of claim 1, further comprising a UV layer disposed between the second facestock layer and the indicia layer.

5. The vehicle identification number (VIN) label of claim 1, further comprising:

a watermark layer disposed between the second facestock layer and the indicia layer, and a UV layer disposed between the watermark layer and the indicia layer.

6. The vehicle identification number (VIN) label of claim 1, wherein the second facestock layer further defines a second window and a third window relative to the first facestock layer; and wherein the indicia layer further forms a second vehicle identification number (VIN) within the second window of the second facestock layer and a third vehicle identification number (VIN) within the third window of the second facestock layer.

7. The vehicle identification number (VIN) label of claim 1, wherein the indicia layer further includes a barcode within the first window of the second facestock layer.

8. The vehicle identification number (VIN) label of claim 1, wherein the indicia layer further includes a logo within the first window of the second facestock layer, the logo configured to be a delimiter for the first vehicle identification number (VIN) positioned within the first window of the second facestock layer.

9. The vehicle identification number (VIN) label of claim 1, wherein the indicia layer is configured to be formed by thermal transfer.

10. A vehicle identification number (VIN) label, comprising:

an adhesive layer;

a self-destruct layer positioned on the adhesive layer;

a first facestock layer positioned on the self-destruct layer, the first facestock layer having a first color;

a second facestock layer positioned on the first facestock layer and defining a first window relative to the first facestock layer such that a portion of the first facestock layer is exposed through the first window; and an indicia layer including indicia in a second color, the indicia being positioned relative to the first window in the second facestock layer such that a first vehicle identification number (VIN) is formed by a contrast between the first color of the portion of the first facestock layer exposed through the first window and the second color of the indicia.

11. The vehicle identification number (VIN) label of claim 10, wherein the indicia forms an outline in the second color of the first vehicle identification number (VIN) relative to the first color on the portion of the first facestock layer exposed through the first window.

12. A vehicle identification number (VIN) label, comprising:

an adhesive layer;

a self-destruct layer positioned on the adhesive layer;

a first facestock layer positioned on the self-destruct layer, the first facestock layer having a first color;

a second facestock layer positioned on the first facestock layer and defining a first window relative to the first facestock layer; and an indicia layer with a first section positioned over at least the first window of the second facestock layer and a second section positioned on the second facestock layer, the first section including a transparent portion and a printed portion, wherein the printed portion is a second color outlining a first vehicle identification number (VIN) relative to the transparent portion such that the first vehicle identification number (VIN) is formed by a contrast between the first color of the first facestock layer exposed through the first window of the second facestock layer and the second color of the printed portion.

13. The vehicle identification number (VIN) label of claim 12, further comprising a watermark layer disposed between the second facestock layer and the second section of the indicia layer, wherein the watermark layer includes a plurality of watermark symbols surrounding the first window.

14. The vehicle identification number (VIN) label of claim 12, wherein the printed portion and the transparent portion form a reverse print of the vehicle identification number (VIN).

15. The vehicle identification number (VIN) label of claim 1, wherein the second facestock layer is the second color.

16. The vehicle identification number (VIN) label of claim 10, wherein the second facestock layer is the second color.

17. The vehicle identification number (VIN) label of claim 12, wherein the second facestock layer is between the second section of the indicia layer and the first facestock layer.

18. The vehicle identification number (VIN) label of claim 17, wherein the second section of the indicia layer is transparent such that the second facestock layer is visible through the second section of the indicia layer.

19. The vehicle identification number (VIN) label of claim 18, wherein the second facestock layer is the second color.

* * * * *